US012491551B2

(12) United States Patent
Jepsen

(10) Patent No.: US 12,491,551 B2
(45) Date of Patent: Dec. 9, 2025

(54) STABILIZATION OF THE ROLLED PRODUCT DURING OPENING AND/OR CLOSING OF A ROLL STAND

(71) Applicant: SMS group GmbH, Düsseldorf (DE)

(72) Inventor: Olaf Norman Jepsen, Siegen (DE)

(73) Assignee: SMS group GmbH, Düsseldorf (DE)

( * ) Notice: Subject to any disclaimer, the term of this patent is extended or adjusted under 35 U.S.C. 154(b) by 171 days.

(21) Appl. No.: 18/251,705

(22) PCT Filed: Oct. 4, 2021

(86) PCT No.: PCT/EP2021/077251
§ 371 (c)(1),
(2) Date: May 3, 2023

(87) PCT Pub. No.: WO2022/096206
PCT Pub. Date: May 12, 2022

(65) Prior Publication Data

US 2023/0405655 A1 Dec. 21, 2023

(30) Foreign Application Priority Data

Nov. 5, 2020 (DE) ..... 10 2020 213 902.4

(51) Int. Cl.
*B21B 37/62* (2006.01)
*B21B 1/26* (2006.01)
(Continued)

(52) U.S. Cl.
CPC ..... *B21B 37/62* (2013.01); *B21B 1/26* (2013.01); *B21B 13/02* (2013.01); *B21B 31/32* (2013.01);
(Continued)

(58) Field of Classification Search
CPC ..... B21B 37/62; B21B 37/68; B21B 37/58; B21B 38/00; B21B 38/10; B21B 37/105;
(Continued)

(56) References Cited

U.S. PATENT DOCUMENTS 8,578,749 B2 11/2013 Klein et al.
2009/0044587 A1 2/2009 Jepsen et al.
(Continued)

FOREIGN PATENT DOCUMENTS

DE 3413424 A1 10/1984
DE 3837101 A1 5/1990
(Continued)

*Primary Examiner* — Teresa M Ekiert
(74) *Attorney, Agent, or Firm* — Smartpat PLC

(57) ABSTRACT

A rolling mill stand has two working rolls forming a roll gap in which a rolled product transported in a conveying direction can be formed. The positioning of at least one working roll is variable in a plane perpendicular to the conveying direction. The rolling mill is used in a method which comprises: conveying the rolled product through the roll gap in the conveying direction and at the same time opening or closing the rolling mill stand by correspondingly increasing or decreasing the roll gap; during opening or closing of the roll stand, detecting a position of the rolled product in front of and/or behind the roll gap in the direction transverse to the conveying direction; and changing the positioning of the corresponding working roll depending on the detected position, so that the rolled product is stabilized at a target position during opening or closing of the roll stand.

14 Claims, 4 Drawing Sheets

(51) Int. Cl.

| | |
|---|---|
| ***B21B 13/02*** | (2006.01) |
| ***B21B 31/32*** | (2006.01) |
| ***B21B 37/68*** | (2006.01) |
| ***B21B 38/00*** | (2006.01) |

(52) U.S. Cl.
CPC ..... *B21B 37/68* (2013.01); *B21B 38/00* (2013.01); *B21B 2013/025* (2013.01)

(58) Field of Classification Search
CPC ..... B21B 31/32; B21B 13/02; B21B 1/26; B21B 2013/025; B21B 2271/02
See application file for complete search history.

(56) References Cited

U.S. PATENT DOCUMENTS

| | | | | |
|---|---|---|---|---|
| 2009/0113968 | A1 | 5/2009 | Pawelski et al. | |
| 2011/0247391 | A1* | 10/2011 | Seidel | B21B 38/105 73/1.79 |
| 2019/0041812 | A1 | 2/2019 | Gafur et al. | |
| 2019/0047029 | A1 | 2/2019 | Grüss et al. | |

FOREIGN PATENT DOCUMENTS

| | | | |
|---|---|---|---|
| DE | 102005051053 | A1 | 4/2007 |
| DE | 102007038758 | A1 | 5/2008 |
| EP | 3208673 | B1 | 6/2019 |
| GB | 1290096 | A | 9/1972 |
| GB | 2329264 | | 3/1999 |
| JP | S5985314 | A | 5/1984 |
| JP | S59189012 | A | 10/1984 |
| JP | S61144208 | A | 7/1986 |
| JP | S6320116 | A | 1/1988 |
| JP | S63020118 | A | 2/1994 |
| JP | H06297017 | A | 10/1994 |
| JP | H08197125 | A | 8/1996 |
| JP | 2011177776 | A | 9/2011 |
| JP | 2020066050 | A | 4/2020 |

* cited by examiner

STABILIZATION OF THE ROLLED PRODUCT DURING OPENING AND/OR CLOSING OF A ROLL STAND

CROSS-REFERENCE TO RELATED APPLICATION

This application is a national stage application, filed under 35 U.S.C. § 371, of International Patent Application No. PCT/EP2021/077251, filed on 4 Oct. 2021, which claims the benefit of German Patent Application No. 10 2020 213 902.4, filed 5 Nov. 2020.

TECHNICAL FIELD

The disclosure relates to a method for opening and/or closing a rolling mill stand during rolling, in particular the hot rolling of a rolled product. The disclosure further relates to a rolling mill stand and a method for rolling a rolled product.

BACKGROUND

In the production of flat-rolled metal products, slabs or strips are conveyed through one or more rolling mill stands. A rolling mill stand has at least two parallel working rolls, which form a roll gap through which the rolled product passes, usually for the purpose of thickness reduction. The relative position of the working rolls for setting the roll gap can be varied, for example, by means of hydraulically positioning one or both working rolls.

In some process situations, the rolled product is conveyed through an open rolling mill stand without the working rolls applying any force to the rolled product for forming. Only after a certain time or a certain strip length is the rolling mill stand closed, in order to start or continue the actual rolling process. For example, during a flying roll change in a casting-roll mill or a tandem rolling train, the roll gap of the rolling mill stand is opened initially, reducing the thickness reduction at such rolling mill stand to zero, in order to allow a roll change. After the roll change, the roll gap is closed.

When closing or opening the roll gap, the rolled product may not remain stable in the desired, usually central, location in the roll gap, but may run off to the side. Small irregularities with regard to the positioning of the working rolls, the geometric shape and the like may cause the relative increase or decrease of the roll gap not to remain constant over the strip width when the rolling mill stand is fed, thus exerting a lateral force on the rolled product, which leads to an undesirable change in position in the lateral direction, that is, in the axial direction of the working rolls.

DE 34 13 424 A1, JP S59 189012 A, JP S59 85314 A and DE 10 2005 051 053 A1 describe methods and devices for controlling the lateral unstable movement of a strip undergoing rolling.

SUMMARY

One object of the invention is to specify an improved concept for opening and closing a rolling mill stand, in particular to improve the reliability of the rolling process.

The object is achieved by a method, a rolling mill stand, and a device as described and claimed. Advantageous embodiments follow from the subclaims, the following description of the invention and the description of preferred exemplary embodiments.

The method, the rolling mill stand and the device are used in particular in a rolling mill for rolling a rolled product made of metal, preferably steel or a non-ferrous metal. The rolled product is preferably a metal strip, in particular a hot strip.

The method relates to the opening and/or closing of a rolling mill stand with at least two working rolls forming a roll gap. The rolled product is transported through the roll gap along a conveying direction for forming. At least one of the two working rolls can be moved in the plane perpendicular to the conveying direction in such a manner that not only the roll gap can be increased or decreased, but also the positioning of the working roll relative to the rolled product can be varied. Thereby, "positioning" refers to the degree of inclination of the working roll in the specified plane relative to the other working roll or to the strip plane, provided that the rolled product is formed to be strip-shaped.

In accordance with the method, the rolled product is transported through the roll gap in the conveying direction, and at the same time the rolling mill stand is opened or closed by increasing or decreasing the roll gap accordingly. In the opened state of the rolling mill stand, the working rolls—in contrast to the closed state—preferably exert no rolling force, or at most a low rolling force, on the rolled product.

A position of the rolled product in front of and/or behind the roll gap in the direction transverse to the conveying direction, that is, in the axial direction of the working rolls, is detected during the opening or closing of the rolling mill stand. The designations "in front of" and "behind" are defined relative to the conveying direction of the rolled product. Depending on the detected position, the positioning of the corresponding working roll is changed in such a manner that the rolled product is held or stabilized at a target position during the opening or closing of the rolling mill stand. In principle, the positioning of both working rolls can also be changed for this purpose.

The roll gap or its geometric shape, as the case may be, is therefore controlled during the opening or closing of the rolling mill stand in such a manner that the rolled product does not run off to the side, but is held close to a target position. In this manner, stabilization of the process of opening and closing the rolling mill stand is achieved with the rolled product being conveyed at the same time, thus improving the quality of production and minimizing any waste. At the same time, particularly efficient production is possible because, for example, a flying roll change is possible during ongoing production without the risk of production interruption or quality losses due to the misplacement of the rolled product in the roll gap.

It should be noted that the terms "position" and "location" are used synonymously in relation to the placement of the rolled product in the roll gap in the transverse direction.

Preferably, the position of the rolled product is detected without contact, which means that no unnecessary forces act on the rolled product in order to carry out the method and, furthermore, the reliability of the corresponding detectors is increased, since they are subject to no wear or only slight wear.

The position of the rolled product is detected optically, for example, preferably by means of one or more cameras, by means of radar or laser scanning. In this manner, existing mills can be retrofitted in a simple and reliable manner in terms of mechanical engineering.

In the case of a strip-shaped rolled product, one or both strip edges can be detected to determine the position. If one or more cameras are used, they can be detected by image recognition, for example, and any deviations from the target position can be determined with the aid of software.

As an alternative to explicitly determining the position of the rolled product, a physical parameter can be used, which indirectly represents the position of the rolled product, such as a strip tension distribution. The strip tension distribution can be measured across the width of the rolled product, that is, in the axial direction of the working rolls, in front of and/or behind the rolling mill stand, and then used for control in order to keep the position of the rolled product stable.

Preferably, the positioning of the working roll is changed hydraulically, by which the ability to position is realized in a simple and reliable manner from a mechanical engineering point of view. For example, two hydraulic cylinders are installed to act as actuators. For this purpose, the hydraulic cylinders may engage directly on the right and left of the relevant working roll, or they can move a structural unit consisting of a working roll and an associated back-up roll. However, the positioning of the working roll can also be varied in other manners, for example by means of one or more electric motors or linear motors.

The method described above in the various embodiments can also be used in a rolling mill, in particular a hot rolling mill, with a plurality of rolling mill stands that together form a rolling train, in particular a tandem train. In such a case, the rolled product is transported through the roll gap of each of the rolling mill stands in the conveying direction, while one or more of the rolling mill stands are opened or closed. During the opening or closing of the corresponding rolling mill stand, a position of the rolled product in front of and/or behind the associated roll gap is detected in the direction transverse to the conveying direction, and the positioning of the corresponding working roll is changed depending on the detected position in such a manner that the rolled product is stabilized or held at a target position during the opening or closing of the corresponding rolling mill stand. In this manner, it is possible to open and close one or more rolling mill stands at the same time, without having to stop the production process or fear quality losses.

The object specified above is further achieved by a rolling mill stand for rolling a rolled product, preferably a metal strip, wherein the rolling mill stand comprises: at least two working rolls, which form a roll gap, in which the rolled product, which can be transported in a conveying direction, can be formed; a positioning device, which is configured to vary the positioning of at least one of the working rolls in a plane perpendicular to the conveying direction and to open or close the rolling mill stand accordingly by increasing or decreasing the roll gap; and a location control system, which is configured to detect a position of the rolled product in front of and/or behind the roll gap in a direction transverse to the conveying direction during the opening or closing of the rolling mill stand and to change the positioning of the corresponding working roll depending on the detected position in such a manner that the rolled product is stabilized or held at a target position during the opening or closing of the rolling mill stand.

The features, technical effects, advantages along with embodiments described with regard to the method apply analogously to the rolling mill stand.

Thus, for the above reasons, the location control system preferably comprises at least one location detector, which is configured to detect the position of the rolled product in front of and/or behind the roll gap without contact.

Preferably, the location detector comprises one or more cameras for the reasons specified above.

Preferably, the location control system further comprises a location evaluation unit in communication with the location detector along with a location controller in communication with the location evaluation unit, wherein the location evaluation unit is configured to determine the current position of the rolled product in the direction transverse to the conveying direction from the detection values of the location detector and to transmit this to the location controller, wherein the location controller is configured to calculate a swivel value for the positioning device from the current position of the rolled product and to control this directly or via a position controller of the positioning device in such a manner that the position of the rolled product is stabilized at the target position during the opening or closing of the rolling mill stand.

The location detector, the location evaluation unit and the location controller may be separate structural units communicating with one another or may be realized integrally. Furthermore, the location control system can be implemented centrally or decentrally, part of Internet-based and/or cloud-based applications or in other manners, as well as accessing databases if necessary. In general, communication between the electronic components, such as between the location control system and the positioning device(s), between the location detector and the location evaluation unit and between the location evaluation unit and the location controller, can be wireless or wired.

Preferably, for the reasons mentioned above, the positioning device comprises one or more, preferably exactly two, hydraulic cylinders, which act as actuators of the positioning device.

Preferably, the rolling mill stand has two back-up rolls, which are in contact with the working rolls accordingly, in order to support the working rolls and prevent or at least limit the deflection of the working rolls under load.

The object specified above is further achieved by a device for rolling a rolled product, preferably a metal strip, which comprises one or more rolling mill stands according to one or more of the embodiments set forth above. In particular, a plurality of rolling mill stands is provided, which rolling mill stands form a rolling train, preferably a tandem rolling train.

The features, technical effects, advantages and exemplary embodiments described with regard to the method along with the rolling mill stand apply analogously to the device.

Further advantages and features of the present invention are apparent from the following description of preferred exemplary embodiments. The features described therein can be implemented alone or in combination with one or more of the features set forth above, provided the features do not contradict one another. The following description of the preferred exemplary embodiments is made with reference to the accompanying drawings.

BRIEF DESCRIPTION OF THE DRAWINGS

Preferred further exemplary embodiments of the invention are explained in more detail by the following description of the figures.

DETAILED DESCRIPTION

Preferred exemplary embodiments are described below with reference to the figures. In this context, identical, similar or similarly acting elements are provided with identical reference signs in the figures, and a repeated description of such elements is partially omitted in order to avoid redundancy.

Figure 1:
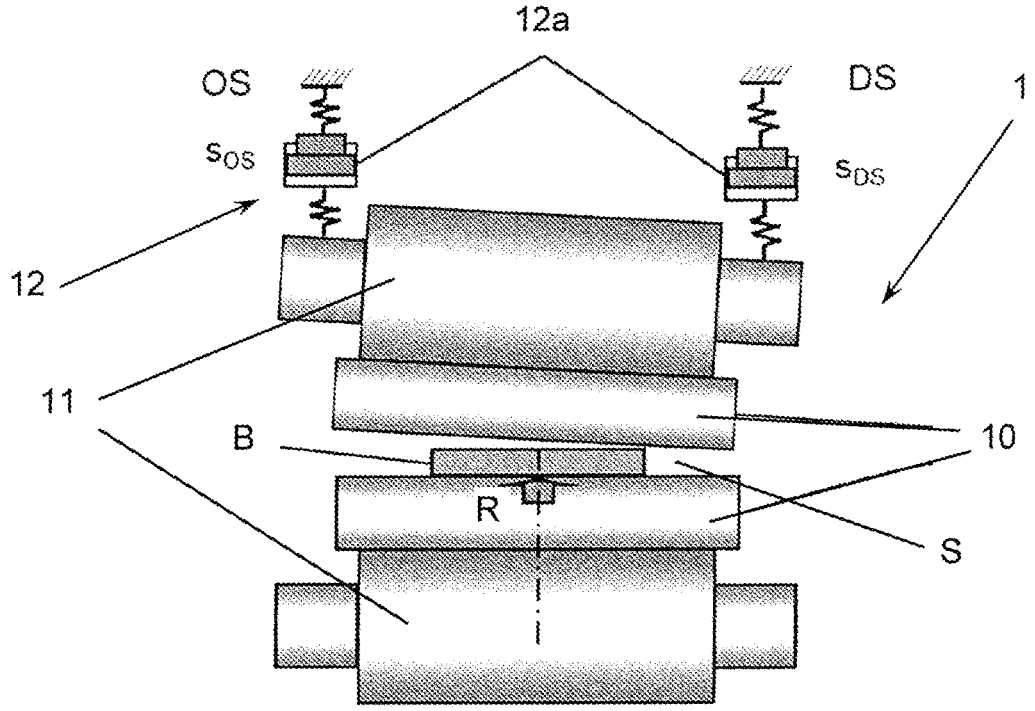
FIG. 1 schematically, a rolling mill stand with working and back-up rolls along with a positioning device for varying the roll gap, wherein the rolling mill stand is shown in an open state.

FIG. 1 schematically shows a rolling mill stand 1 for rolling a rolled product B, in particular in strip form, which can be transported in a conveying direction R (perpendicular to the plane of the figure).

In accordance with the exemplary embodiment, the rolling mill stand 1 is designed as a four-high rolling mill stand, preferably for rolling a hot strip, that is, for use in a hot flat rolling mill. However, the rolling mill stand 1 can also have a different structure and/or can be designed for a different application, for example as a cold rolling mill stand for metal strips or a structural rolling mill stand.

The rolling mill stand 1 of the present exemplary embodiment has two parallel, opposing working rolls 10, which form a roll gap S, and two associated back-up rolls 11, which are in contact with the working rolls 10 accordingly in order to support the working rolls 10 and prevent or at least limit deflection of the working rolls 10 under load.

The rolling mill stand 1 further comprises a positioning device 12, which is configured to move at least one of the two working rolls 10, preferably the upper working roll 10, in the vertical direction, that is, in the direction of gravity, in order to change the roll gap S. For this purpose, the positioning device 12 can move the structural unit consisting of the working roll 10 and the associated back-up roll 11, as can be seen from a comparison of FIGS. 1 and 2.

The positioning device 12 is further configured to adjust, in addition to the vertical position of the working roll 10 concerned, its inclination in the plane perpendicular to the conveying direction R. This can be realized in that the positioning device 12 has two points of engagement on the working roll 10 or the structural unit consisting of working roll 10 and back-up roll 11. In the present exemplary embodiment, the two setting positions are designated as "setting position of the operating side" $s_{OS}$ and "setting position of the drive side" $s_{OS}$, motivated by the position of the drive (not shown in the figures) for the rolls 10, 11 on the drive side DS and the position of access for operating personnel on the operating side OS, such as for maintenance of the rolling mill stand 1, replacement of rolls 10, 11 and the like.

In the present exemplary embodiment, the positioning device 12 comprises two hydraulic cylinders 12*a*, which act as actuators of the positioning device 12. However, the positioning of the working roll 10 can also be varied in other manners, for example by means of one or more linear and/or electric motors.

Figure 2:
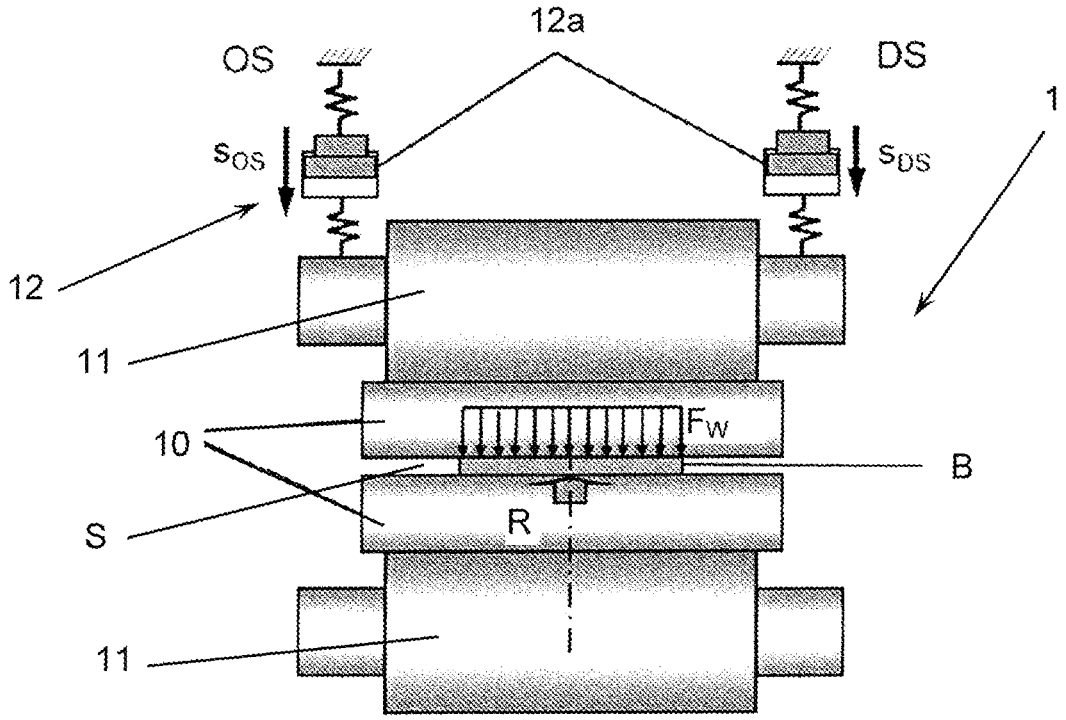
FIG. 2 schematically, a rolling mill stand with working and back-up rolls along with a positioning device for varying the roll gap, wherein the rolling mill stand is shown in a closed state.

The rolling mill stand 1 of FIG. 1 is shown in an open or pulled-up state, in which the roll gap S is open and thus no thickness reduction of the rolled stock B is taking place. An open roll gap S may be required at the start of the rolling process, for threading the rolled product B into the one or more rolling mill stands 1, for maintenance work, a flying roll change, that is, a roll change during ongoing production, and in other process situations. FIG. 2 shows the rolling mill stand 1 in a lowered-down or closed state, in which the working and back-up rolls 10, 11 are in their operating position, in which a rolling force $F_W$ acts on the rolled product B and it is plastically deformed, in particular reduced in thickness.

When opening and/or closing the roll gap S, the rolled product B may not remain stable in the desired, usually central location in the roll gap S, but may run off to the side, that is, to the left/right in the perspective of FIGS. 1 and 2. This may be caused by an inclined position of the positionable working roll 10, as shown in exaggerated form in FIG. 1. The setting position $s_{OS}$ of the operating side and the setting position $s_{OS}$ of the drive side do not match.

Figure 3:
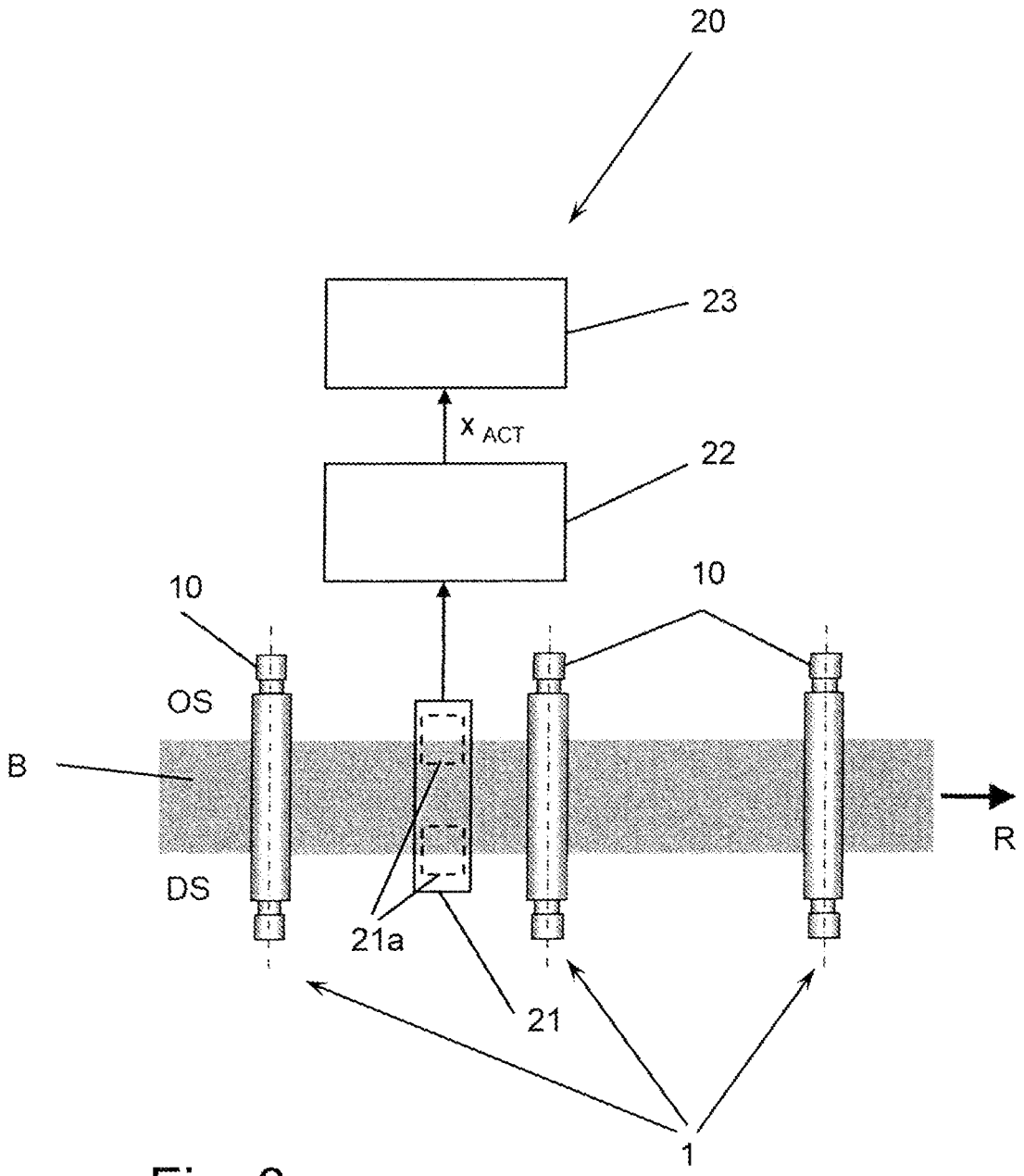
FIG. 3 schematically, a rolling train with a plurality of rolling mill stands and a location control system.
Figure 4:
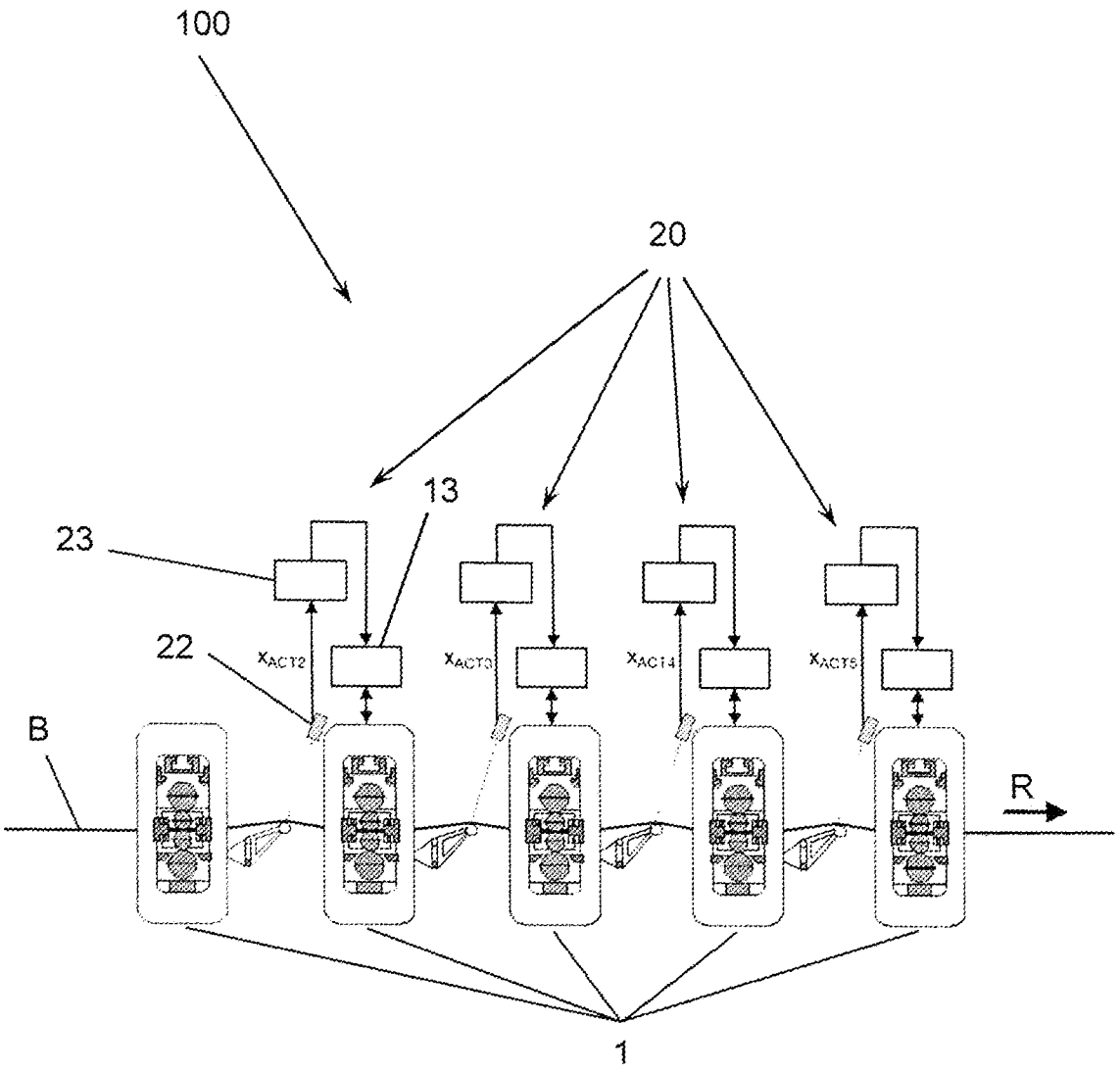
FIG. 4 schematically, a tandem rolling train with a plurality of rolling mill stands and a plurality of location control systems.
Figure 5:
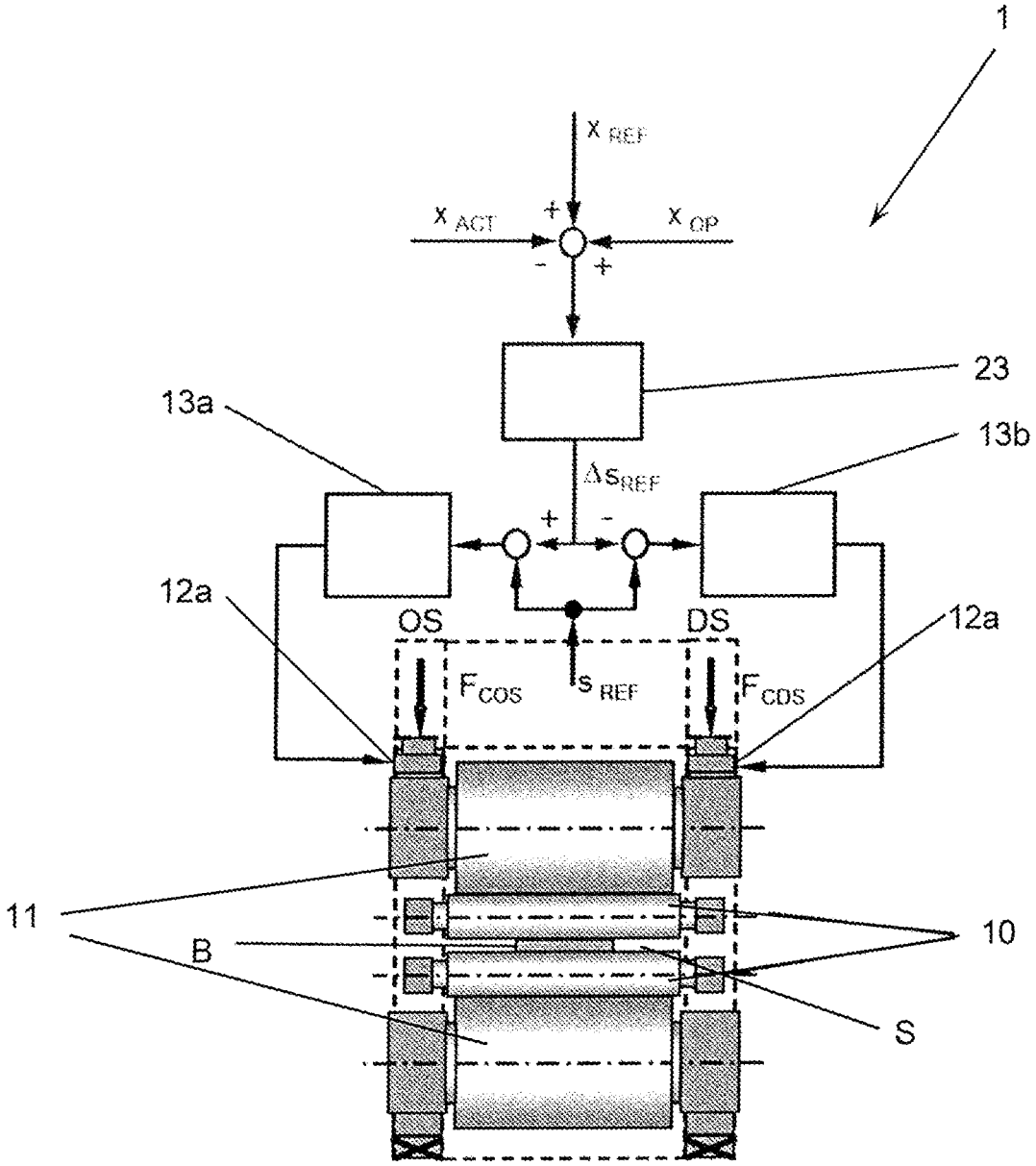
FIG. 5 schematically, a rolling mill stand with working and back-up rolls along with a location control system in accordance with a further exemplary embodiment.

In order to stabilize the process of opening and closing the rolling mill stand 1, a location control system 20 is provided, which is shown schematically in FIGS. 3, 4 and 5.

The location control system 20 comprises one or more location detectors 21, which are configured to detect the position of the rolled product B in front of and/or behind (as seen in the conveying direction R) the roll gap S of a rolling mill stand 1, preferably without contact. For this purpose, the location detector 21 preferably comprises one or more cameras 21*a*, which are directed, for example, at the strip edges of the rolled product B, if strip-shaped. Such a location detector 21 is shown in FIG. 3, which shows a schematic top view of a rolling train with a plurality of rolling mill stands 1. The location detector 21 detects the location or position, as the case may be, of the rolled product B in the lateral direction, that is, in the axial direction of the working rolls 10.

As an alternative to using one or more cameras 21*a*, the location detector 21 can detect the position of the rolled product B by using a detector based on a different principle. For example, the position of the rolled product B, in particular any strip edges, can be detected by radar, laser scanning or another optical method. Alternatively, instead of the explicit location of the rolled product B, a parameter that indirectly represents the location of the rolled product B, such as a strip tension distribution, can be used. The strip tension distribution can be measured across the width of the rolled product B, that is, in the axial direction of the working rolls 10, in front of and/or behind the rolling mill stand 1 and can be used for control.

The location detector 21 is in communication with a location evaluation unit (location evaluator) 22, which is configured to determine the current position xACT of the rolled product B in the lateral direction from the detection values of the location detector 21 and to transmit such information to a location controller 23.

From the current position $x_{ACT}$ of the rolled product B, the location controller 23 calculates a swivel value (differential positioning value) for the positioning device 12 of the working rolls 10. By swiveling the working roll 10 by the positioning device 12, the rolled product B can be moved to the side. The location controller 23 now controls the relevant positioning device 12 directly or via a position controller 13 of the positioning device 12 (see FIGS. 4 and 5) in such a manner that the rolled product location is stabilized during the closing of the roll gap S. In other words, the roll gap S is closed in such a manner that the location or position, as the case may be, of the rolled product B remains as close as possible to a target position. For this purpose, the location controller 23 is in wired or wireless communication with the positioning device 12.

The location detector 21, the location evaluation unit 22 and the location controller 23 may be separate structural units communicating with one another or may be realized integrally. Furthermore, the location control system 20 can be implemented centrally or decentrally, part of Internet-based and/or cloud-based applications or in other manners, as well as accessing databases if necessary. In general, communication between the electronic components, such as between the location control system 20 and the positioning device(s) 12, between the location detector 21 and the location evaluation unit 22 and between the location evaluation unit 22 and the location controller 23, can be wireless or wired.

FIG. 4 shows a tandem rolling train 100 with a plurality of rolling mill stands 1, wherein a plurality of location control systems 20 are installed in association with different rolling mill stands 1.

FIG. 5 schematically shows a rolling mill stand 1 with a location control system 20 in accordance with another exemplary embodiment. Here, the position controller 13 of the positioning device 12 is divided into a position controller 13*a* of the operating side OS and a position controller 13*b* of the drive side DS, which are configured for position control of the corresponding side, preferably of the corresponding hydraulic cylinder 12*a*.

FIG. 5 also shows the influence of the location control of the rolled product B on the position control of the positioning device 12, wherein $F_{COS}$ designates the positioning force on the operating side OS and $F_{CDS}$ denotes the positioning force on the drive side DS. $s_{REF}$ designates a target value of the mean setting position, $\Delta s_{REF}$ designates a target value of the differential setting position (swivel value), $x_{REF}$ designates a target value of the rolled product location, and $x_{OP}$ designates an additional target value for the rolled product location, for example defined by a higher-level system control or an operator. Thereby, $s=(s_{DS}-s_{OS})/2$ applies to the mean setting position and $\Delta s=s_{DS}-s_{OS}$ to the differential setting position.

The control of the rolled product location set forth herein enables stabilization of the process of opening and closing a rolling mill stand 1, while a rolled product B is being transported, by keeping the location of the rolled product B close to a target position in the lateral direction, that is, transverse to the conveying direction R. In this manner, the quality of production can be improved and any rejects can be minimized. Furthermore, by installing the location control system 20 on a plurality of rolling mill stands 1 of a rolling train, it is possible to open and close one or more rolling mill stands 1 simultaneously.

LIST OF REFERENCE SIGNS

1 Rolling mill stand
10 Working roll(s)
11 Back-up roll
12 Positioning device
12*a* Hydraulic cylinder
13 Position controller of the positioning device
13*a* Position controller of the operating side
13*b* Position controller of the drive side
20 Location control system
21 Location detector
22 Location evaluation unit
23 Location controller
100 Tandem rolling train
R Conveying direction
B Rolled product
S Roll gap
OS Operating side
DS Drive side
$F_W$ Rolling force
$s_{OS}$ Setting position of the operating side
$s_{DS}$ Setting position of the drive side
$x_{ACT}$ Current position of the rolled product
$F_{COS}$ Positioning force on the operating side
$F_{CDS}$ Positioning force on the drive side
$s_{REF}$ Target value of the mean setting position
$\Delta s_{REF}$ Target value of the differential setting position
$x_{REF}$ Target value of the rolled product location
$x_{OP}$ Additional target value
s Middle setting position
$\Delta s$ Differential setting position

The invention claimed is:

1. A method for opening and/or closing a rolling mill stand (1) with two working rolls (10) forming a roll gap (S) in which a rolled product (B) transported in a conveying direction (R) can be formed, wherein a positioning of at least one of the two working rolls (10) is variable in a plane perpendicular to the conveying direction (R), the method comprising:

conveying the rolled product (B) through the roll gap (S) in the conveying direction (R) and at the same time opening or closing the rolling mill stand (1) by correspondingly increasing or decreasing the roll gap (S);

during opening or closing of the rolling mill stand (1), detecting a position of the rolled product (B) in front of and/or behind the roll gap (S) in a direction transverse to the conveying direction (R); and changing the positioning of the at least one of the two working rolls (10) depending on the detected position, so that the rolled product (B) is stabilized at a target position during opening or closing of the rolling mill stand (1), wherein closing the rolling mill stand (1) includes transitioning the two working rolls (10) from a pulled-up state in which a thickness of the rolled product (B) is not reduced to a lowered-down state in which the thickness of the rolled product (B) is reduced, and wherein opening the rolling mill stand (1) includes transitioning the two working rolls (10) from the lowered-down state to the pulled-up state.

2. The method according to claim 1, wherein the position of the rolled product (B) is detected without contact.

3. The method according to claim 2, wherein the position of the rolled product (B) is detected optically by one or more cameras (21*a*), by radar, or by laser scanning.

4. The method according to claim 1, wherein the rolled product (B) is a metal strip.

5. The method according to claim 1, wherein the positioning of the working roll (10) is changed hydraulically.

6. A method, comprising:

providing a plurality of rolling mill stands (1) in a rolling train, each having two working rolls (10) forming an associated roll gap (S) in which a rolled product (B) transported in a conveying direction (R) can be formed, wherein a positioning of at least one working roll (10)

per rolling mill stand (1) is variable in a plane perpendicular to the conveying direction (R), and the method further comprises:

conveying the rolled product (B) through the associated roll gap (S) of each of the rolling mill stands (1) in the conveying direction (R) and at the same time opening or closing one or more of the rolling mill stands (1) by correspondingly increasing or decreasing the associated roll gap (S);

during opening or closing of a corresponding rolling mill stand (1), detecting a position of the rolled product (B) in front of and/or behind the associated roll gap (S) transverse to the conveying direction (R); and changing the positioning of the corresponding working roll (10) depending on the detected position, so that the rolled product (B) is stabilised at a target position during opening or closing of the corresponding rolling mill stand (1), wherein closing the corresponding rolling mill stand (1) includes transitioning the two working rolls (10) from a pulled-up state in which a thickness of the rolled product (B) is not reduced to a lowered-down state in which the thickness of the rolled product (B) is reduced, and wherein opening the rolling mill stand (1) includes transitioning the two working rolls (10) from the lowered-down state to the pulled-up state.

7. A rolling mill stand (1) for rolling a rolled product (B), comprising:

two working rolls (10), which form a roll gap (S), in which the rolled product (B), which can be transported in a conveying direction (R), can be formed;

a positioning device (12), which is configured to vary the positioning of at least one of the two working rolls (10) in a plane perpendicular to the conveying direction (R) and to open or close the rolling mill stand (1) accordingly by increasing or decreasing the roll gap (S); and a location control system (20), which is configured to detect a position of the rolled product (B) in front of and/or behind the roll gap (S) transverse to the conveying direction (R) during the opening or closing of the rolling mill stand (1) and to change the positioning of the at least one of the two working rolls (10) depending on the detected position in such a manner that the rolled product (B) is stabilized at a target position during the opening or closing of the rolling mill stand (1), wherein closing the corresponding rolling mill stand (1) includes transitioning the two working rolls (10) from a pulled-up state in which a thickness of the rolled product (B) is not reduced to a lowered-down state in which the thickness of the rolled product (B) is reduced, and wherein opening the rolling mill stand (1) includes transitioning the two working rolls (10) from the lowered-down state to the pulled-up state.

8. The rolling mill stand (1) according to claim 7, wherein the location control system (20) comprises at least one location detector (21), which is configured to detect the position of the rolled product (B) in front of and/or behind the roll gap (S) without contact.

9. The rolling mill stand (1) according to claim 8, wherein the location detector (21) comprises one or more cameras (21*a*).

10. The rolling mill stand (1) according to claim 8, wherein the location control system (20) comprises a location evaluator (22) in communication with the location detector (21) and a location controller (23) in communication with the location evaluator (22), wherein the location evaluator (22) is configured to determine a current position (xACT) of the rolled product (B) transverse to the conveying direction from detection values of the location detector (21) and to transmit the current position (xACT) to the location controller (23), wherein the location controller (23) is configured to calculate a swivel value for the positioning device (12) from the current position (xACT) of the rolled product (B) and to control the positioning device (12) directly or via a position controller (13) of the positioning device (12) in such a manner that the position of the rolled product (B) is stabilized at the target position during the opening or closing of the rolling mill stand.

11. The rolling mill stand (1) according to claim 7, wherein the positioning device (12) comprises exactly two hydraulic cylinders (12*a*).

12. The rolling mill stand (1) according to claim 7, wherein the rolling mill stand (1) has two back-up rolls (11), which are in contact with the working rolls (10).

13. A device (1) for rolling a rolled product (B), which comprises one or more rolling mill stands (1) according to claim 7.

14. The device (1) according to claim 13, wherein a plurality of rolling mill stands (1) is provided, which rolling mill stands form a tandem rolling train (100).

* * * * *